United States Patent [19]

Hrachowitz et al.

[11] 4,157,192

[45] Jun. 5, 1979

[54] SKI BINDING APPARATUS

[75] Inventors: Frank Hrachowitz; Rossler Ernst, both of Vienna; Josef Svoboda, Schwechat, all of Austria

[73] Assignee: Gertsch AG, Zug, Switzerland

[21] Appl. No.: 709,416

[22] Filed: Jul. 28, 1976

Related U.S. Application Data

[63] Continuation of Ser. No. 554,714, Mar. 3, 1975, abandoned.

[30] Foreign Application Priority Data

Mar. 14, 1974 [AT] Austria ..... 2215/74
Dec. 4, 1974 [AT] Austria ..... 9706/74

[51] Int. Cl.[2] ..... A63C 9/086
[52] U.S. Cl. ..... 280/618; 280/636
[58] Field of Search ..... 280/618, 611, 624, 634, 280/636

[56] References Cited

U.S. PATENT DOCUMENTS 3,900,205 8/1975 Sittmann ..... 280/618
3,936,064 2/1976 D'Alessio ..... 280/618

FOREIGN PATENT DOCUMENTS 2003307 8/1971 Fed. Rep. of Germany ..... 280/618

*Primary Examiner*—David M. Mitchell
*Attorney, Agent, or Firm*—Blanchard, Flynn, Thiel, Boutell & Tanis

[57] ABSTRACT

An improved arrangement for holding the rear end of a sole plate on which is mounted a ski boot to the upper surface of a ski. A lock is provided for securing the rear end of the sole plate to the ski, which lock is nonmovable in the position of use of the sole plate and during occurrences of a safety release of the sole plate from engagement with the ski but, on the other hand, is manually movable against the force of a spring.

12 Claims, 15 Drawing Figures

SKI BINDING APPARATUS

This is a continuation of application Ser. No. 554,714, filed Mar. 3, 1975, and now abandoned.

FIELD OF THE INVENTION

The invention relates to a device for ski bindings, on which a sole plate carrying the ski boot is supported at at least one end.

BACKGROUND OF THE INVENTION

A device for ski bindings is known, on which a sole plate is supported with a support surface provided at its rear end. The sole plate has a recess at its front end, into which recess engages a drop-in pin which is under the pressure of a spring and acts approximately parallel to the longitudinal axis of the ski. If an overload occurs, for example due to a fall, in order to release the sole plate from the ski, the sole plate is moved against the force of the spring loading the drop-in pin until a release occurs at the rear end of the sole plate from engagement with a support device. This support device is fixed nonmovably on the ski. During a stepping in procedure, the rear end of the sole plate must first be guided against or partly under the support device and then the boot tip must be pressed down, whereby the spring-loaded drop-in pin of the front ski mounting is pressed back. The adjusted force of the spring which determines the release moment must be overcome. This does not only require a large amount of force, but there exists also the danger, that the sole plate will come to lie not in the correct central position, but in a tilted position between the support device and the spring-loaded drop-in pin on the ski.

The purpose of the invention is to avoid these disadvantages and to produce a device, which assures a simple and easy arranging and releasing of the sole plate without effecting the mounting in the position of use or during a safety release.

This is achieved by the device having a lock which is provided nonmovably in the position of use of the sole plate and during a safety release, however, is manually movable against the force of a spring.

Therefore, during a stepping in procedure, it is no longer necessary to overcome the large force of a release spring, but the lock is pressed back against the relatively small force of its associated spring, which holds it only in one end position. During use or during a safety release, the lock cannot be pressed back by upward forces applied thereto by the sole plate. The sole plate can thus, during the stepping in procedure, be easily centered in the required central position, without the danger of tiltings occurring. The inventive device saves space and material, because it cooperates with the sole plate not outside, but below the ski boot sole.

BRIEF DESCRIPTION OF THE DRAWINGS

The subject matter of the invention is exemplarily illustrated in several embodiments in the drawings, in which.

DETAILED DESCRIPTION

Figure 1:
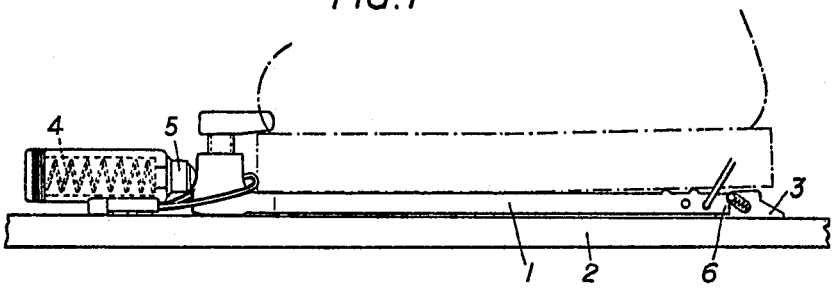
FIGS. 1 and 2 are side and top views, respectively, of an arrangement for mounting a sole plate on a ski.
Figure 2:
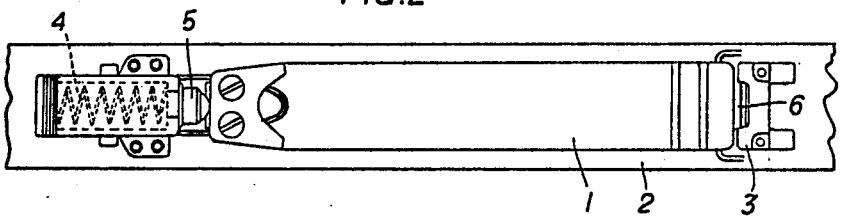

As can be recognized from FIGS. 1 and 2, a sole plate 1 is releasably held on the upper surface of a ski 2 and on which sole plate is secured to a ski boot. The sole plate 1 is supported adjacent its rear end on a support device 3 and cooperates adjacent its front end with a spring-loaded drop-in pin 5 loaded by a release spring 4. The sole plate can be released either from the engagement at its front end or at its rear end both in a lateral and also an upward direction. If a safety release takes place at the rear end, the rear end part 6 of the sole plate slides off from, and becomes disengaged from, the support device 3 and the spring-loaded drop-in pin 5 is moved forwardly against the force of the release spring 4 by the forwardly moving sole plate 1.

Figure 3:
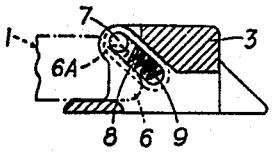
FIGS. 3 and 4 are side and top views, respectively, of an inventive support device.
Figure 4:
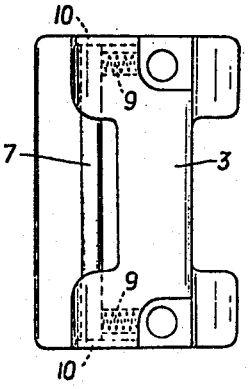

More specifically, the construction of the support device 3 is illustrated in FIGS. 3 and 4. The sloped end surface 6A at the rear end 6 of the sole plate 1 is overlapped and gripped by a locking bolt 7. The locking bolt 7 is movably supported against the force of springs 9 received in lateral slots 8 of the device 3. End covers 10 prevent ice, snow, dirt and the like from entering into the slots.

When it is desired to secure the sole plate 1 to the ski, the front end of the sole plate is placed into engagement with the pin 5 and then placed into engagement with the locking bolt 7. A downward force on the sole plate 1 will effect a movement of the locking bolt 7 in the guide slots 8 against the force of the relatively weak spring 9 downwardly and backwardly until the end position is reached. The locking bolt 7 will then snap thereby again back into its end position shown in FIG. 3 under the pressure of the springs 9 to overlap and grip the sloped end surface 6A of the sole plate 1 so that same is securely held on the ski. An arbitrary release can take place in a simple manner by an easy manual pressing back of the locking bolt 7 against the weak springs 9. However, the locking engagement cannot be released by the sole plate 1. The sloped end surface 6A of the sole plate 1 has substantially the same inclination as the guide slots 8. The inclination of the sloped end surface 6A of the sole plate could be slightly larger with respect to the horizontal line to ease the snapping in of the locking bolt 7 during the stepping in procedure. However, the self-locking action is not to be overcome, since otherwise a force component would be created which would press back the locking bolt 7 in the slots 8.

Figure 5:
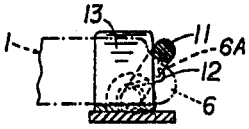
FIGS. 5 to 7 are associated views of a different inventive construction of the support device.
Figure 6:
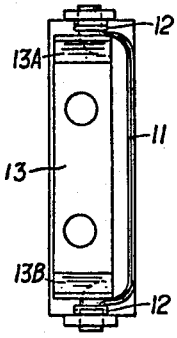
Figure 7:
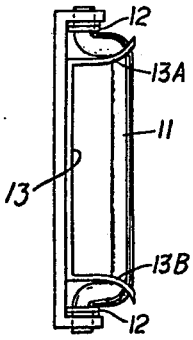

According to FIGS. 5 to 7, the locking bolt is defined by a pivotally supported bar 11. Torsion springs 12 press the bar 11 against fixed stops 13 fixed to the ski, which stops form with their upwardly and outwardly extending legs 13A and 13B a step-in guide for the sole plate 1 (see FIG. 7). During the stepping in procedure, the bar 11 is pivoted rearwardly against the force of the weak torsion springs 12 and snaps in the end position over the sloped end surface 6A of the sole plate 1. The inclination of the sloped end surface 6A is again designed such that the bar 11 cannot be moved rearwardly by upward forces applied to the rear end of the sole plate 1.

Figure 8:
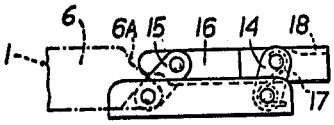
FIGS. 8 to 15 are four further possibilities of construction, each in two associated views.
Figure 9:
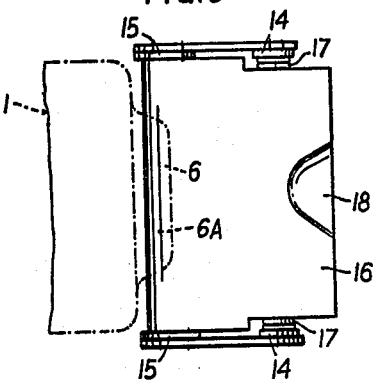

In FIGS. 8 and 9, the support device has two control linkages 14,15, which are hingedly connected to a locking member 16. Springs 17 urge the locking member 16 into an overlapping relation to the sloped end surface 6A on the sole plate 1. Again the overlapping grip is self-locking so that the locking member 16 cannot be moved from the position of use by upward forces applied to the end 6 of the sole plate 1. However, during the stepping in procedure, the locking member 16 is pressed back against the force of the weak springs 17 by the sole plate 1 and then snaps over the sloped end surface 6A. For a manual release operation, an operating recess 18 is provided so that an unlocking can take place in a simple manner by pushing down on the rear end thereof to effect a pivoting of the linkages 14,15 about the pivot axes for their supports.

Figure 10:
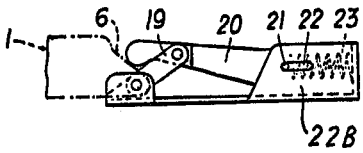
Figure 11:
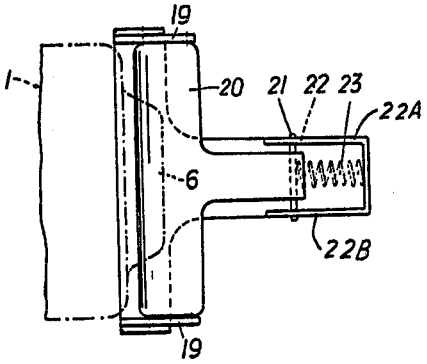

The construction according to FIGS. 10 and 11 differs from the earlier exemplary embodiment in that only one control linkage 19 is hingedly connected to the locking member 20. In place of the second control linkage, the locking member 20 is guided by a bolt 21 received in longitudinal slots 22 in a pair of horizontally spaced legs 22A and 22B secured to the ski. A spring 23, which engages the end of the locking member 20 presses the locking member into overlapping relation with the end surface 6A of the sole plate 1. The stepping in procedure is the same as in the preceding examples.

Figure 12:
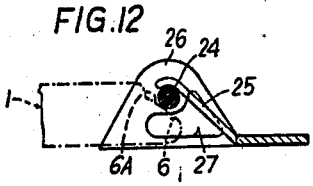
Figure 13:
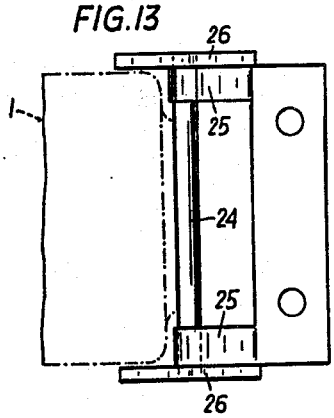

In the construction according to FIGS. 12 and 13, the locking member is defined by a locking bolt 24 arranged transversely to the longitudinal direction of the ski and rests against a stop 25 fixed to the ski. The stop 25 extends forwardly and upwardly substantially inclined to the horizontal, which inclination corresponds in the inclination of the sloped end surface 6A of the sole plate 1. The locking bolt 24 is held in side plates 26, which are formed of an elastic material, for example of rubber, plastic or the like. The locking bolt 24 cannot be moved from the position of use by upward forces applied to the sole plate 1, but in the case of a safety release at the rear end, as has already been described, the end 6 will slide out of engagement with the locking bolt 24 which remains in its position. However, during a stepping in procedure, it is possible to move the locking bolt 24 by a downward force applied thereto by the sole plate 1, or also manually, against the force of the elastic side plates 26 along the stop 25. Further, recesses 27 can be provided in the side plates 26 to increase the elasticity thereof.

Figure 14:
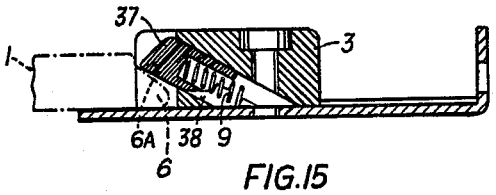
Figure 15:
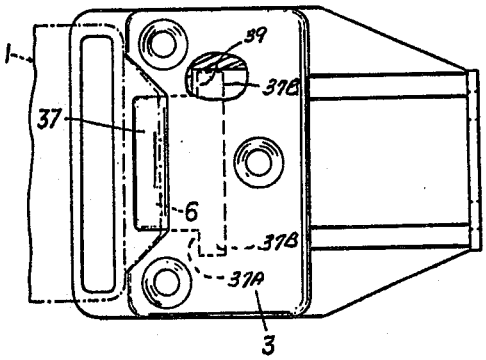

According to FIGS. 14 and 15, the sloped end surface 6A of the sole plate 1 is overlapped and gripped by a locking member constructed as a slide 37. The slide 37 is T-shaped (FIG. 15) is guided in a guideway 38 which is provided within recesses in the support device 3 and can be moved against the force of one or several springs 9. The surfaces 37A of laterally projecting arms 37B are urged by the springs into engagement with stops 39 on the support member 3. The slide 37 projects over the end surface 6A only in the area of the end 6 of the sole plate 1 and is otherwise protected on all sides against the outside. Thus ice, snow, dirt and the like is prevented from entering into the guideway 38.

During a stepping in procedure, the rear end 6 of the sole plate will engage and push the slide 37 backwardly and downwardly in the guideway 38 against the force of the relatively weak springs 9, until the end position is reached. The slide 37 snaps again into its end position, illustrated in FIGS. 14 and 15, under the pressure of the springs 9 into engagement with the stops 39 to overlap and grip the sloped end surface 6A of the sole plate 1 so that same is securely held on the ski. A manual release can take place in a simple manner by an easy manual pressing back of the slide 37 against the weak springs 9. However, the lock cannot be released by upward forces applied thereto by the sole plate 1. The sloped end surface 6A of the sole plate 1 has substantially the same inclination, as the guideway 38. The inclination of the sloped end surface 6A of the sole plate 1 can be slightly greater to the horizontal, as shown in the drawings, which slightly eases the snapping in of the slide 37 during the stepping in procedure. However, the self-locking action is not to be overcome because otherwise a force component is created, which would press the slide 37 back in the guideway 38.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski binding arrangement, comprising:

an elongated plate separate from a ski and adapted to have a sole of a ski boot mounted on an upper surface thereof, said plate having an inclined surface adjacent one end thereof inclined to the plane of said upper surface;

spaced holding means connected to said plate adjacent the ends thereof for holding a toe and a heel portion of said ski boot onto said upper surface of said plate;

spaced releasable securement means mounted on said ski for releasably securing both ends of said plate to said ski with a predefined magnitude of force, said securement means including at least one support member mounted on said ski adjacent said one end of said plate and said inclined surface thereon and a movable locking member mounted on said support member, guide means on said support member for guiding the movement of said locking member into and out of overlapping relation with said inclined surface on said plate, said guide means effecting a movement of said locking member in a direction generally parallel to said inclined surface;

fixed stop means on said support member for limiting the movement of said locking member at least in a direction of movement thereof toward said overlapped relation with said inclined surface; and resilient means for urging said locking member into engagement with said stop means and to said overlapping position, said resilient means yielding to a predefined force applied thereto by said locking member in response to a relative movement between said plate and said ski during a placing of said plate between said spaced releasable securement means.

2. A ski binding arrangement according to claim 1, wherein said inclined surface is adjacent the said one of said spaced holding means for securing said heel portion of said ski boot to said plate.

3. A ski binding arrangement according to claim 1, wherein said guide means includes a guide surface inclined downwardly in a direction away from said upper surface of said plate and rearwardly from the said one of said spaced holding means for securing said heel portion of said ski boot to said plate whereby said locking member is movable away from said stop means on said guide surface downwardly and rearwardly of said plate when a vertically downward force is applied thereto by said plate and a further movement under the urging of said resilient means toward said stop means and said overlapping relation after the lowermost portion of said inclined surface has passed below the path of movement of said locking member.

4. A ski binding arrangement according to claim 1, wherein said locking member is a slide which projects out of said support member only in the area of the end of said sole plate and is otherwise enclosed on all sides from the outside.

5. A ski binding arrangement according to claim 4, wherein said guide means includes a recess in said support means inclined upwardly and in a direction generally parallel to the inclination of said inclined surface on said plate when said plate is releasably secured to said ski by said securement means, said slide and said resilient means being located in said recess, said stop means limiting the outward projection of said locking member from said support member.

6. A ski binding arrangement according to claim 1, wherein said guide means includes a pair of laterally spaced elongated slots, the longitudinal axes of which are parallel and are inclined upwardly in a direction generally parallel to the inclination of said inclined surface on said plate when said plate is releasably secured to said ski by said securement means;

wherein said locking member is a bolt, the ends of which are slidably received in said slots; and wherein said stop means is defined by the upper ends of said slots.

7. A ski binding arrangement according to claim 1, wherein said support member includes pivot means defining a pivot axis extending tranversely to the longitudinal axis of said ski;

wherein said locking member is an elongated generally U-shaped bar having a bight portion and a pair of legs pivotally secured to said pivot means, said bight portion overlying said inclined surface on said plate when said plate is releasably secured to said ski by said securement means;

wherein said resilient means is a torsion spring to bias said bight portion toward said overlying position; and wherein said stop means limits the movement of said bight portion toward said overlying position.

8. A ski binding arrangement according to claim 7, wherein said stop means include upwardly and outwardly extending legs to define a step-in guide for said sole plate, said bight portion engaging said legs to limit the movement thereof toward said overlying position.

9. A ski binding arrangement according to claim 1, wherein said support member includes pivot means defining a pivot axis extending traversely to the longitudinal axis of said ski; and wherein said guide means includes at least a pair of laterally spaced linkage members pivotally secured to both said locking member and said pivot means.

10. A ski binding arrangement according to claim 9, wherein said support member has means defining an elongated slot therein;

wherein one end of said locking member remote from said securement to said linkage members has pin means secured thereto and received in said slot for guiding said locking member for movement longitudinally of said ski while the other end of said locking member is supported for movement by said pivotally connected linkage members; and wherein said stop means is defined by one end of said slot.

11. A ski binding arrangement according to claim 1, wherein said support member is elastic; and wherein said locking member is supported in said elastic support member, said resilient means being the elasticity of said elastic support member.

12. A ski binding arrangement according to claim 11, wherein said elastic support members each have recesses therein to enhance the elasticity thereof.

* * * * *

UNITED STATES PATENT AND TRADEMARK OFFICE

CERTIFICATE OF CORRECTION

PATENT NO. : 4 157 192

DATED : June 5, 1979

INVENTOR(S) : Franz Hrachowitz et al

It is certified that error appears in the above-identified patent and that said Letters Patent are hereby corrected as shown below:

Change name of inventor "Frank Hrachowitz" to ---Franz Hrachowitz---.

Change name of inventor "Rossler Ernst" to ---Ernst Rossler---.

Under "Foreign Application Priority Data" change "2215/74" to ---2115/74---.

Column 5, line 35; change "tranversely" to ---transversely---.

Signed and Sealed this

*Twenty-fifth* Day of *December 1979*

[SEAL]

*Attest:*

SIDNEY A. DIAMOND

*Attesting Officer*

*Commissioner of Patents and Trademarks*